United States Patent [19]

Marcon et al.

[11] Patent Number: 4,838,066

[45] Date of Patent: Jun. 13, 1989

[54] PROCESS AND A DEVICE FOR THE PRODUCTION OF GROOVES ON A WALL OF REVOLUTION

[75] Inventors: Charles Marcon, Chagny; Jean Poullain, Chalon-sur-Saone, both of France

[73] Assignee: Escofier Technologie, S.A., Chalon-sur-Saone, France

[21] Appl. No.: 238,591

[22] Filed: Aug. 31, 1988

Related U.S. Application Data

[63] Continuation of Ser. No. 919,147, filed as PCT FR86/00018 on Jan. 22, 1986, published as WO86/04274 on Jul. 31, 1986, abandoned.

[30] Foreign Application Priority Data

Jan. 23, 1985 [FR] France ..... 85 01330

[51] Int. Cl.[4] ..... B21H 3/04

[52] U.S. Cl. ..... 72/95; 72/190

[58] Field of Search ..... 72/95, 100, 102, 110, 72/190, 191, 240

[56] References Cited

U.S. PATENT DOCUMENTS 2,991,672 7/1961 Meyer et al. .
3,439,519 4/1969 Gerding .
3,955,391 5/1976 Wilson .

FOREIGN PATENT DOCUMENTS 1306295 9/1962 France .
1551913 11/1968 France .
808865 2/1959 United Kingdom .

*Primary Examiner*—Lowell A. Larson
*Attorney, Agent, or Firm*—Dennison, Meserole, Pollack & Scheiner

[57] ABSTRACT

The process according to the invention relates to the production of grooves such as helical threads on the wall of tubes composed of ductile or plastic materials without removal of matter.

It involves using a knurling tool (11) of radius ($R_1$) which is freely rotatable about an axis ($X_3$). This axis covers, in the direction indicated by the arrow F2, a determined closed curve (12) which, in the figure, is a circumference of radius (R2) and of axis ($X_4$).

The enveloping curve of the path of the shaping edge (15) of the knurling tool has a region of intersection (13) with the wall of revolution (10) of axis ($X_2$). The diameter of the knurling tool is greater than the diameter of the circumference (12). A helical thread is obtained by moving the wall of revolution (10) in relative manner along its axis ($X_2$) relative to the knurling tool (11).

22 Claims, 6 Drawing Sheets

Fig. 2
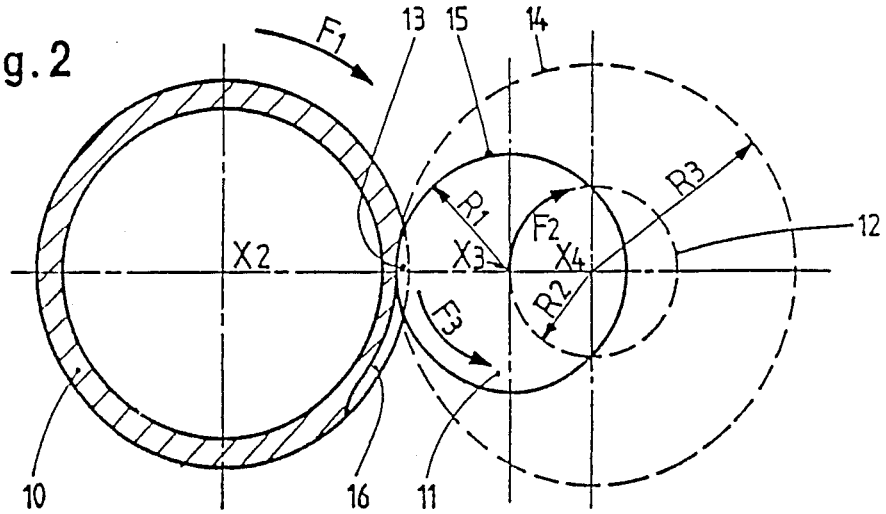
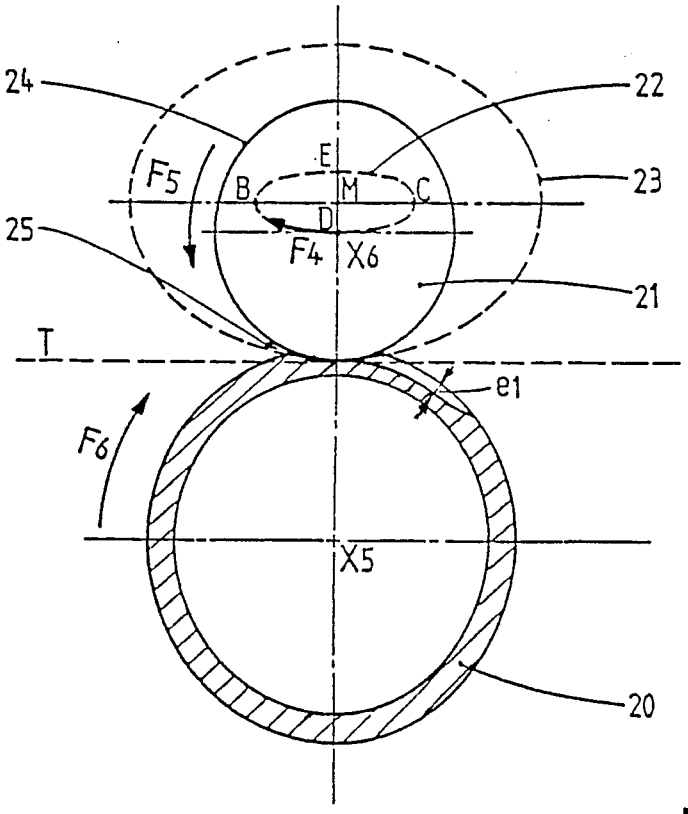
Fig. 3

59
60
61
62
63
64
65
66
67
68
69
70
71
72
73
74
75
76
77
78
79
80
81
82
83
F10
F11
F12
F13
X22
X23
X24
X25

PROCESS AND A DEVICE FOR THE PRODUCTION OF GROOVES ON A WALL OF REVOLUTION

This is a continuation of co-pending application Ser. No. 919,147 filed as PCT FR86/00018 on Jan. 22, 1986, published as WO86/04274 on Jul. 31, 1986, now abandoned.

The process and the device forming the subject of the invention relate to the production of grooves on the wall of revolution of a hollow body without removal of matter.

They relate more particularly to the production of grooves in the form of helical threads on the wall of revolution of tubes composed of ductile materials such as metals or alloys.

This device comprises a knurling tool 1 mounted freely rotatably on an axis $X_0$ which rolls continuously on the external wall of the tube 2 which is rotated about its axis $X_1$. The axis $X_0$ is perpendicular to the radius 3 of the tube 2 passing through the region of intersection 4 between the edge 5 of the knurling tool 1 and the wall of the tube 2. This axis $X_0$ is inclined by an angle $\alpha 1$ to a straight secant parallel to the axis $X_1$. It is thus possible to produce a helical thread 6 on the wall of revolution of the tube 2 by a relative translation movement of this tube 2 along its axis $X_1$ relative to the knurling tool 1 combined with its rotational movement about this same axis.

The desired depth of the thread 6 is obtained by exerting on the knurling tool 1 sufficient pressure to enable its edge 5 to penetrate to the desired depth into the wall of the tube 2. This pressure depends on the dimensions of the tube 2 and of the knurling tool 1 and on the depth of the thread 6 to be produced. In the case of tubes of which the wall thickness is relatively small it is observed that, instead of achieving displacement of material limited to the zone of intersection 4 and to its immediate vicinity, deformation of the entire tube which may be elastic or even permanent and which renders the process inapplicable is produced.

To reduce the pressure exerted locally on the tube, it is possible to use several knurling wheels which roll continuously on the tube while following the same groove or helical thread and are also distributed round the periphery of the tube. By exerting a relatively limited pressure on each of these knurling tools by means of its shaft, it is possible to form a groove or thread having a depth greater than that which could be produced by applying the same pressure to a single knurling tool without significant deformation of the tube wall. The furrow dug by the first knurling tool is deepened during the passage of each of the following knurling tools. Furthermore, the distribution of the knurling tools about the tube allows the stresses to be balanced.

However, in a large number of cases, such a process cannot be applied because the tubes are too thin to tolerate the pressure of the knurling tools without significant deformation.

The use of an internal mandrel does not permit the problem to be solved either because swelling of the tube which alters its dimensions and, in particular, those of the thread or of the groove to be produced is observed.

French Patent No. 1 551 913 describes a process for forming metal articles from billets or blanks (page 1, right-hand column, lines 1–10) which involves turning a row of small continuously working rollers one after the other over an orbit, mounting a blank so that its surface region intersects the orbit and is in turn struck by the rollers in uninterrupted succession so that the metal of the surface region is subjected to a plastic deformation while matching the contour of the rollers. It is essential that these rollers are held by support rollers or members which are stationary in their region of action. FIGS. 1 to 4 of this patent show a cylindrical blank about which a helical groove is formed by means of small rollers 12 mounted rotatably about axes, these axes being distributed over the periphery of a circular rotating cage 10. These rollers are held by a central roller 16 against which they rest. As shown in FIG. 2, use can also be made of a cage which is articulated in the form of a chain 10 provided with rollers 22 which travels in a closed circuit along an elliptical orbit while resting on a central support 20 on which the rollers 22 rest. The working rollers 12 are also connected to the chain and rest on the rollers 22. The chain is driven by a suitable mechanism. Rectilinear grooves may also be produced over a certain length, as shown in FIG. 2 in which the central support comprises two rectilinear large faces connected by small rounded sides. Toothing may also be formed on the periphery of a wheel. Although the document only describes the forming of solid parts, the possibility of also forming hollow blanks is mentioned without further details.

Tests have shown that it is possible to use small forming rollers similar to those just described for forming annular or helical grooves on the cylindrical wall of revolution of hollow bodies such as tubes by mounting these rollers on at least one rotating cage which rotates them about its axis. These rollers successively strike the wall of the hollow body which is itself rotated about its axis. An annular groove is thus produced. A helical groove is obtained by simultaneously moving the hollow body along its axis. French patent application No. 8501330, on whose priority the present application is based, describes such a method of producing grooves on a hollow body wall.

It has however been found during tests that the use of a row of small working rollers or knurling tools according to the teaching of French Pat. No. 1551913 and having a small diameter relative to the dimensions of the orbit or closed path along which they travel has serious drawbacks. In fact, if the small diameter of the rollers reduces the strain exerted on the wall of the hollow body, it harms the precision of the grooves and the flanks thereof. It is also found that the circular path covered by knurling tools having small dimenions relative to the diameter of this path, such as those shown in FIG. 6 of the priority application, has the drawback of causing a succession of impacts exerted by each knurling tool at the moment when it comes into contact with the wall of the hollow body. These impacts create local defects and, in particular, wrenching and folds which it is impossible to eliminate or attenuate in many cases. These also cause vibrations which also damage the quality and precision of the profile of the grooves produced.

Tests have shown, in particular, that the process and the device described in French Pat. No. 1 551 913 do not allow helical grooves or threads to be produced on the wall of revolution of a hollow body, of a quality which is good enough to allow assembly under perfect conditions of tubes which are threaded in this way at their ends.

These tests have also shown that it is not possible to produce such grooves or such threads on non-cylindrical walls of revolution of hollow bodies.

The possibility has been investigated of developing a process and a device for carrying out the process which allow annular or helical grooves of high precision which are free from local defects to be produced. The possibility of producing such grooves in the walls of relatively thin hollow bodies without significant deformation outside the region in the immediate vicinity of the groove has also been investigated. Finally, the possibility has been investigated of developing a process for producing such grooves or such threads on the wall of revolution of hollow bodies of non-cylindrical shape so as to allow the process to be adapted, in particular, to the production of helical threads on the conical ends of tubes with the object of obtaining screw-threaded assemblies with conical threads of satisfactory quality.

The process and the device according to the invention allow these problems to be solved in a particularly effective manner.

The process according to the invention involves forming, without removing material, at least one groove on the wall of revolution of a hollow body constituted by a ductile or plastic material. In this process, at least one revolving knurling tool comprising at least one shaping edge and mounted freely rotatably on an axis is used. This axis moves in parallel with itself so that its point of intersection with a perpendicular plane follows in cyclic manner a path reserved for it along a determined closed curve, said path not being followed by another knurling tool. The enveloping curve of the path of at least one shaping edge of the knurling tool comprises a region of intersection with the wall of revolution, this region moving in relative manner about this wall.

The knurling tool comprises at least one shaping edge of which the greatest diameter is greater than the length of the diagonal of the determined closed curve of which the extension cuts the region of intersection in its centre as well as the axis of the hollow body. If the determined closed curve is a circumference, the diameter thereof is therefore smaller than that of the knurling tool. The determined closed curve advantageously has an elongated shape. It is preferably orientated such that the diagonal of this curve of which the extension cuts the region of intersection in its centre as well as the axis of the wall of revolution of the hollow body is substantially perpendicular to the longest diagonal of this predetermined closed curve.

A helical groove is produced on the wall of revolution of the hollow body by a relative translation movement of this wall of revolution along its axis relative to the zone of intersection combined with the movement of rotation of said wall.

The plane of the enveloping curve of the path of the shaping edge of the knurling tool may advantageously be orientated about an axis contained in this plane and intersecting both the axis of the wall of revolution and the region of intersection.

When a helical groove is formed, the plane of the enveloping curve is preferably orientated such that it is parallel to a tangent to the helical groove in the region of intersection during production.

Several knurling tools distributed round the axis of the wall of revolution of the hollow body such that the enveloping curves of their shaping edges offer with the wall of revolution different regions of intersection which are distributed round this wall of revolution are advantageously used. When at least two knurling tools are used for producing the same groove in a wall of revolution, the enveloping curves of their shaping edges also advantageously have different depths of penetration in their regions of intersection with this wall.

When a helical groove is produced on a non-cylindrical wall of revolution of a hollow body, the distance between the axis of this wall of revolution and at least one enveloping curve corresponding to the path of the shaping edge of a knurling tool is varied so as to control the depth of the zone of intersection.

For an observer placed in the extension of the axis of the wall of revolution of the hollow body, the direction of rotation of this wall of revolution and the direction of the passage through a closed curve determined by the axis of the corresponding knurling tool are preferably the same.

It is advantageous to use, in combination with at least one shaping knurling tool, a smoothing knurling tool of which the axis is kept at a substantially constant distance from the wall of revolution and of which the edge rolls in a groove already formed by the shaping knurling tool while continuously exerting a pressure on the base and on the lateral walls of this groove.

The process according to the invention is applied in particular to the production of grooves in the form of helical threads, on the end wall of cylindrical or conical metal tubes so as to produce high quality screwed assemblies, for example by means of female screw-threaded connections.

The invention also relates to a device for forming grooves without removal of material in the wall of revolution of a hollow body composed of a ductile or plastic material by means of at least one revolving knurling tool which is mounted freely rotatably on an axis and is provided with at least one shaping edge. This device comprises a support which rotates round an axis, is connected to a first means of rotation and is provided with gripping means allowing a hollow body comprising a wall of revolution to be grasped such that the axis of this wall coincides with the axis of rotation of the support. This device also comprises at least one rigid knurling tool holder on which there is mounted a single knurling tool which is freely rotatable on an axis integral with this knurling tool holder. A second driving means moves this knurling tool holder in cyclic manner so that the knurling tool axis moves in parallel with itself and its point of intersection with a perpendicular plane passes in cyclic manner through a determined closed curve, a control means for varying the distance between the knurling tool holder and wall of revolution such that the enveloping curve of cyclic movement of at least one forming edge of the knurling tool comprises a region of intersection with this wall of revolution.

The knurling tool comprises at least one shaping edge of which the largest diameter is greater than the length of a diagonal of the determined closed curve of which the extension intersects the zone of intersection in its centre as well as the axis of the wall of revolution of the hollow body.

The device advantageously comprises a third driving means which allows relative translation of the wall of revolution of the hollow body along its axis relative to at least one shaping knurling tool mounted on the corresponding knurling tool holder.

At least one knurling tool holder can advantageously be orientated about an axis which is located in the plane of the enveloping curve of the single knurling tool path corresponding to this knurling tool holder. This axis intersects both the axis of the wall of revolution and the region of intersection between this wall of revolution and this enveloping curve.

The movement of the knurling tool holder is advantageously produced such that the predetermined closed curve has an elongated shape. It is thus preferably orientated such that a diagonal situated in its plane, of which the extension cuts the zone of intersection in its centre as well as the axis of the wall of revolution of the hollow body, is substantially perpendicular to the longest diagonal of the predetermined closed curve.

The device advantageously comprises a fourth driving means which allows at least one knurling tool holder to be moved in the direction of the axis of the wall of revolution as a function of the relative translation of the wall of revolution along its axis relative to this knurling tool holder.

The device preferably comprises several knurling tool holders each equipped with a single shaping knurling tool distributed about the axis of the wall of revolution.

The device advantageously comprises at least one knurling tool which comprises several shaping edges.

It is also advantageous if the device comprises at least one knurling tool holder equipped with a smoothing knurling tool of which the axis does not perform cyclic movement. This knurling tool holder comprises a means of adjustment which allows the edge of the smoothing knurling tool to rest against the wall of a groove already formed on the wall of revolution of the hollow body.

Some advantageous embodiments of the process and of the device according to the invention are described below in a non-limiting manner. IN THE DRAWINGS:

FIG. 2 is a schematic sectional view of a first embodiment of the invention.

FIG. 3 is a schematic sectional view of a second embodiment of the invention.

FIG. 2 shows schematically a first embodiment of the process according to the invention.

Figure 1:
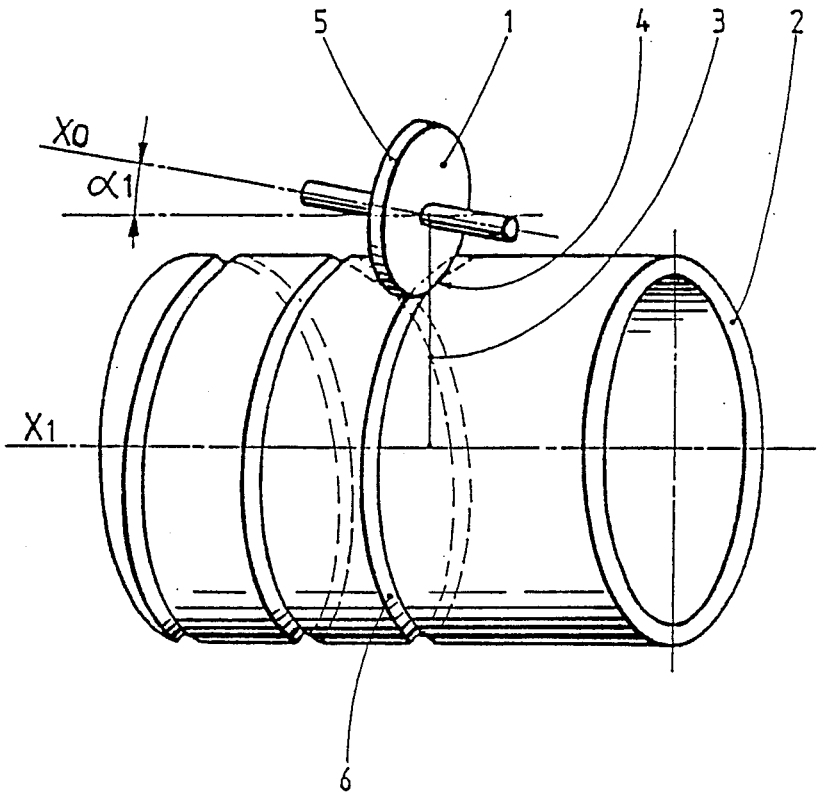
FIG. 1 is a perspective view of a known device for forming a helical groove with a rolling tool.

The wall of revolution 10 of a hollow body is seen in section along a plane perpendicular to its axis $X_2$. The revolving knurling tool 11 is mounted freely rotatably on an axis $X_3$ which is caused to gyrate in parallel with itself about the axis $X_4$ by a driving means (not shown). The radius R1 of the shaping edge of the knurling wheel 11 is greater than the radius of gyration R2 of the axis $X_3$ about the axis $X_4$. The diameter of the shaping edge of the knurling tool is therefore greater than that of any diagonal of the predetermined closed curve 12 and therefore all the more greater than the diagonal of which the extension cuts the region of intersection 13 in its centre as well as the axis $X_2$. As a result, the radius R3 of the enveloping curve 14 is greater than R1 and tends towards it when the value of R2 diminishes. Such an arrangement reduces the angle of incidence of the shaping edge 15 of the knurling tool at the moment when it makes contact with the base of the groove 16 being formed. This gives the walls of the groove a better surface state and therefore greater precision. It is also noted that the direction of rotation of the wall of revolution 10 and of gyration of the axis $X_3$ about the axis $X_4$ indicated by arrows F1 and F2 are the same. It is found that the best results are achieved in this way: the arrow F3 indicates the direction of rolling of the knurling tool 11. As shown below, the results are particularly favourable if helical threads are produced on the wall of revolution of a hollow body.

FIG. 3 shows schematically a further embodiment of the process according to the invention. The wall of revolution 20 of a hollow body of axis $X_5$ is shown in section perpendicularly to this axis. A knurling tool 21 is mounted freely rotatably on an axis $X_6$ perpendicular to the plane of the figure. This axis moves parallel to itself in accordance with the process according to the invention so that its point of intersection with a perpendicular plane follows in cyclic manner a path reserved for it along the non-circular determined closed curve 22. This path is covered in the direction of the arrow F4 owing to a rigid and moveable knurling tool holder (not shown) which drives the axis $X_6$. This curve 22 is elongated and close in shape to an oval or an ellipse. Its greatest diagonal BC is orientated relative to the hollow body of axis $X_5$ such that it cuts at point M, substantially at right angles, the diagonal ED of which the extension cuts in its centre the zone of intersection 25 between the enveloping curve 23 of the path of the shaping edge of the knurling tool 21 and the wall 20 of the hollow body and also cuts the axis $x_5$. In the case of this figure, the diagonal BC is substantially parallel to the tangent T to the curve 23 in the zone of intersection 25. It is found that the length of the short diagonal E-D merely needs to be at least equal to the depth of penetration e1 of the edge of the knurling tool in the wall 20 for there to be no interaction possible between this edge and this wall during the return travel of the axis $X_6$ along the branch B,E,C of the curve 22. The arrow F5 indicates the direction of rotation of the knurling wheel in contact with the wall 20. The arrow F6 indicates the direction of rotation of the wall 20 about the axis $X_5$. Experience has shown that the direction of rotation of this wall is preferably the same as the direction of travel of the closed curve determined by the point of intersection of the axis $X_6$ with this curve.

An observer looking at FIG. 3 and therefore being located in the extension of the axis $X_5$ sees that the direction of the arrows F4 and F6 is clockwise. The ovalized shape of the determined closed curve 22 has the very great advantage of reducing the angle of attack of the shaping edge of the knurling tool 21 at the moment when it comes into contact with the wall 20 considerably reducing the impact caused at this instant. The increased diameter of the knurling tool 21 which is rendered possible by the use of a single knurling tool guided along the path of the closed curve 22 acts essentially in the sense of progressive action of the shaping edge 24 on the wall 20. A groove which is substantially free from defects and which is observed in the case of multiple knurling tools or rollers of small diameter mounted on a single knurling tool holder and describing a circular path of great diameter relative to that of the rollers or knurling tools is thus obtained.

The quality of the groove is also dependent on the shaping work performed during each pass of the shaping edge of the knurling tool 21 in the region of intersection 25. This unitary shaping work is adjusted by acting on the one hand on the frequency with which the enveloping curve 23 is followed by the shaping edge 24 and on the other hand on the speed of rotation of the wall 20 about its axis $X_5$. This shaping work should in any case remain below the limit which would cause unnacceptable permanent deformation of the wall of the tube 20 over its entire thickness.

In most cases, it is advantageous to use several knurling tools.

These knurling tools are distributed round the wall of revolution of the hollow body and the axis of each one moves in such a way that its point of intersection with a perpendicular plane covers the corresponding determined closed curve. The curve of the path of the shaping edge of each knurling tool has its own distinct region of intersection with the wall. It is advantageous that the determined closed curves covered by the axes of the knurling tools are similar so as to balance the stresses exerted on the wall, but this is not essential. Each of the knurling tools is driven in such a way that its axis covers the corresponding predetermined closed curve, as stated in the case in FIG. 3, owing to a rigid and moveable corresponding knurling tool holder. The knurling tools may be arranged in such a way that the enveloping curves of the paths of their shaping edges are located in a same plane perpendicular to the axis of the wall of revolution of the hollow body. An annular groove which is covered successively by the knurling tools used is thus formed.

It is also possible to form a helical groove by moving the wall of revolution along its axis at a speed which is synchronized with the speed of rotation of the wall of revolution so as to define the pitch of the helix with precision. It is often preferable to perform the contrary, that is merely to rotate the wall of revolution of the hollow body, for example by means of a face chuck to which it is fixed. A frame on which the knurling tool holders which drive the knurling tools are mounted is thus rendered integral with the carriage of the lathe.

This carriage can thus travel synchronously with the speed of rotation of the wall of revolution owing to the leading screw of the lathe. The shaping edges of the knurling tools must be offset from one another in parallel with the axis of the hollow body so as to contribute to the shaping of the same helical groove. If, for example, four knurling tools are distributed at 90° from one another round the same wall of revolution in order to produce a helical groove of pitch P the foremost knurling tool attacks the formation of the groove while the others which follow the formation of this same groove have to be offset respectively by P/4, 2P/4 and 3P/4 along the axis.

It is possible progressively to form the grooves by using knurling tools of differing diameters so as to vary the depth of penetration. The profiles of the shaping edges can also vary from one knurling tool to another in order to produce the profile of the groove to be obtained in a progressive manner. Instead of varying the diameter of the knurling tools, it is also possible to vary the depth of the region of intersection between the enveloping curve of the path of the shaping edge and the wall of revolution of the hollow body.

It is advantageous in certain cases to use multiple knurling tools, that is comprising several shaping edges. This permits several passes on the same helical groove. Such multiple knurling tools may also allow screw-cutting comprising several parallel helical threads to be carried out.

Figure 4:
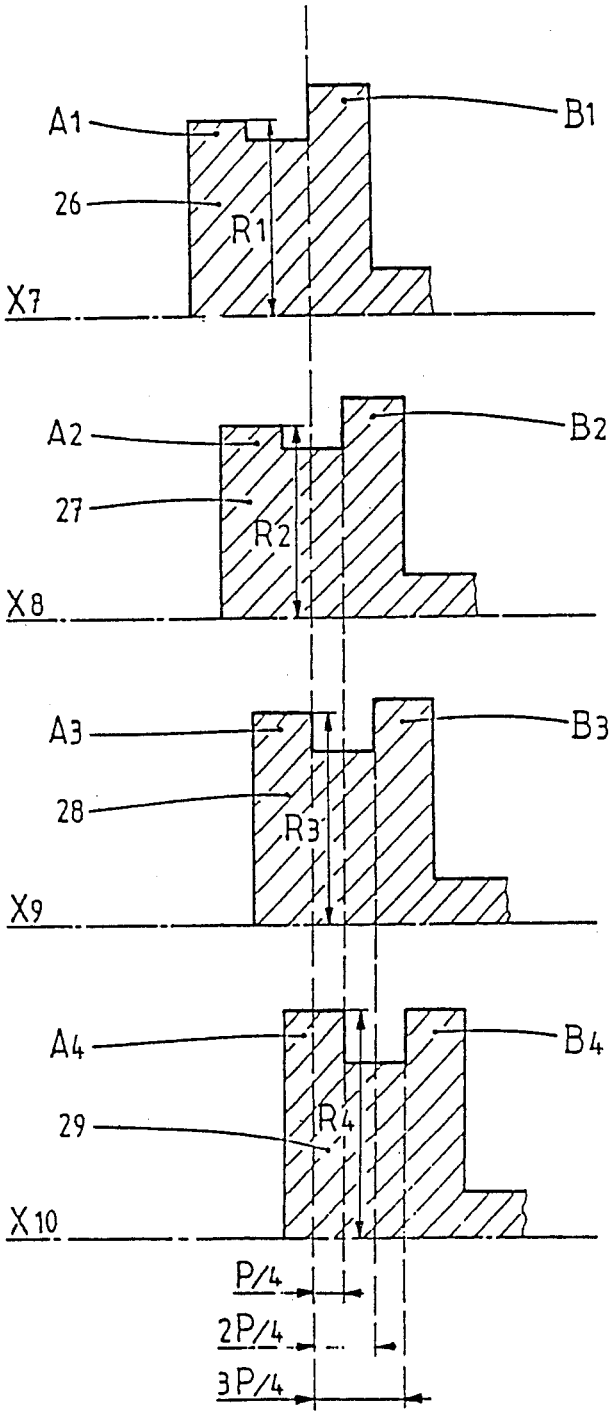
FIG. 4 is a partial sectional view of a set of knurling tools having two shaping edges according to the invention.

FIG. 4 shows schematically some half sections of four knurling tools 26, 27, 28, 29 mounted freely rotatably round the four axes $X_7$, $X_8$, $X_9$, $X_{10}$. These knurling tools are distributed round the wall of revolution of a hollow body and the axis of each of them travels over a determined closed curve which is circular in the manner shown in FIG. 2. The regions of intersection of the enveloping curves of the paths of the shaping edges of each of these knurling tools are distributed substantially at 90° from one another round the wall of revolution. Moreover, as stated above and as a helical thread of pitch P is to be produced, the first knurling tool 26 which attacks the formation of the thread is followed by the other three 27, 28, 29 which are offset respectively in parallel with the axis of the hollow body by P/4, 2P/4 and 3P/4.

Each of these knurling tools comprises two shaping edges: $A_1$ and $B_1$, $A_2$ and $B_2$, $A_3$ and $B_4$. The shaping edges $A_1$, $A_2$, $A_3$, $A_4$ have respective increasing radii $R_1$, $R_2$, $R_3$, $R_4$ allowing a helical thread having the desired depth to be formed in a single revolution of the wall about its axis. The second shaping edges $B_1$, $B_2$, $B_3$, $B_4$ have substantially the same radius, equal to $R_4$. Their passage during a second revolution of the wall, in the thread already formed by the first shaping edges, equalises the thread by eliminating certain inequalities and by increasing the superficial cold-working if necessary. The second shaping edge $B_1$, $B_2$, $B_3$, $B_4$ is obviously offset on each knurling tool 26, 27, 28, 29 relative to the first shaping edge $A_1$, $A_2$, $A_3$, $A_4$ by the desired distance so that the metal is worked at the desired location.

If a groove is produced in the form of a helical thread, the precision is improved by orienting the axes of the knurling tools such that the lateral flanks of their shaping edges are substantially parallel to a tangent to the helical thread in the region of intersection.

Figure 5:
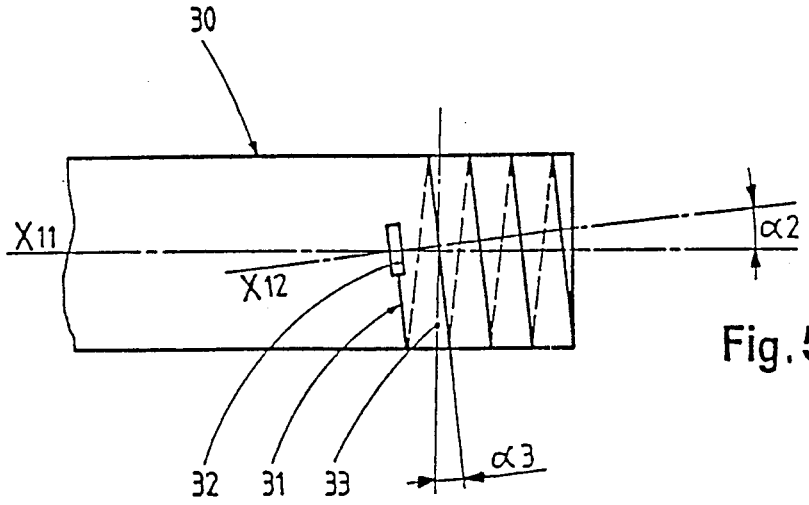
FIG. 5 is a schematic view of the shaping of a helical thread on the cylindrical wall of revolution of a hollow body by means of a knurling tool by the process according to the invention.

FIG. 5 shows a plane view of the cylindrical wall of revolution of a hollow body 30 of axis $X_{11}$ on which a helical thread shaped groove 31 is being formed. A knurling tool 32 is shown in the region of intersection between the enveloping curve of its shaping edge and the wall of the hollow body 30. This knurling tool is mounted rotatably on an axis $X_{12}$ which, itself mounted on a moving knurling tool holder, cyclically performs a path along a closed curve which is determined while maintaining its orientation.

This axis $X_{12}$ is in a plane substantially parallel to the plane tangential to the generating line of the wall of the hollow body 30 passing through the region of intersection specified above. In the case shown in Figure 5, this tangential plane is substantially parallel to the plane of the figure. It can be seen that the axis $X_{12}$ is inclined by an angle $\alpha 2$ to a line parallel to the axis of revolution $X_{11}$ which intersects it. This angle $\alpha 2$ is preferably substantially equal to the angle $\alpha 3$ of inclination of a tangent to the helical thread 31 relative to the plane perpendicular to the axis $X_{11}$, the track of this plane being shown at 33. The inclination of an axis such as $X_{12}$ of a knurling tool such as 32 is obtained by rotating the knurling tool holder (not shown) about an axis perpendicular to the axis $X_{11}$ of the wall of revolution and passing through the region of intersection between the enveloping curve of the shaping edge of the knurling tool 32 and the wall of revolution 30 of the hollow body. Such a measure of inclining the axes of the knurling tools may be carried out, for example, each time that a groove or a helical thread is to be produced.

Figure 6:
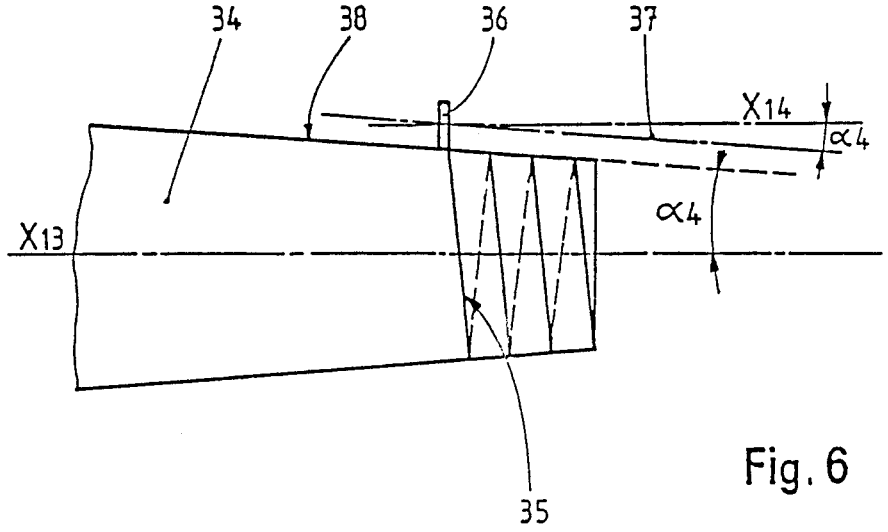
FIG. 6 is a schematic view of the shaping of a helical thread on the conical wall of revolution of a hollow body by the process according to the invention.

FIG. 6 shows the wall of revolution 34 of a hollow body of axis $X_{13}$ of which the external surface is conical. A helical thread 35 is formed on this surface by means of knurling tools such as 36 which rotate about axes such as $X_{14}$. Each of these knurling tools is mounted on a corresponding knurling tool holder (not shown). In the case in this figure, the knurling tool axis $X_{14}$ is located in a plane parallel to the axis of revolution $X_{13}$ and perpendicular to a straight line which is itself perpendicular to this axis, this line passing through the region of intersection between the enveloping curve of the cyclic path of the shaping edge of the knurling tool and the wall. This plane therefore forms an angle $\alpha 4$ which is equal to half the angle at the apex of the cone with a line 37 parallel to the generating line 38 of the conical wall. Under these conditions, the shaping edge of each knurling tool does not act symmetrically on the wall. This has few disadvantages if the angle $\alpha 4$ is small. As explained in FIG. 5, the axes of the knurling tools such $X_{14}$ maybe orientated in such a way that the lateral flanks of the shaping edges are rendered parallel to the helical thread 35. This orientation is effected by rotating the knurling tool holder about an axis perpendicular to the axis $X_{13}$ passing through the region of intersection between the enveloping curve and wall.

During the relative translation of the wall of revolution 34 along its axis $X_{13}$ relative to the knurling tool 36, the distance between the knurling tool holder and the axis $X_{13}$ is varied continuously so that the enveloping curve of the path of the shaping edge of the knurling tool 36 constantly intersects the wall of revolution with substantially constant penetration. A known cone following means is used for this purpose.

Figure 7:
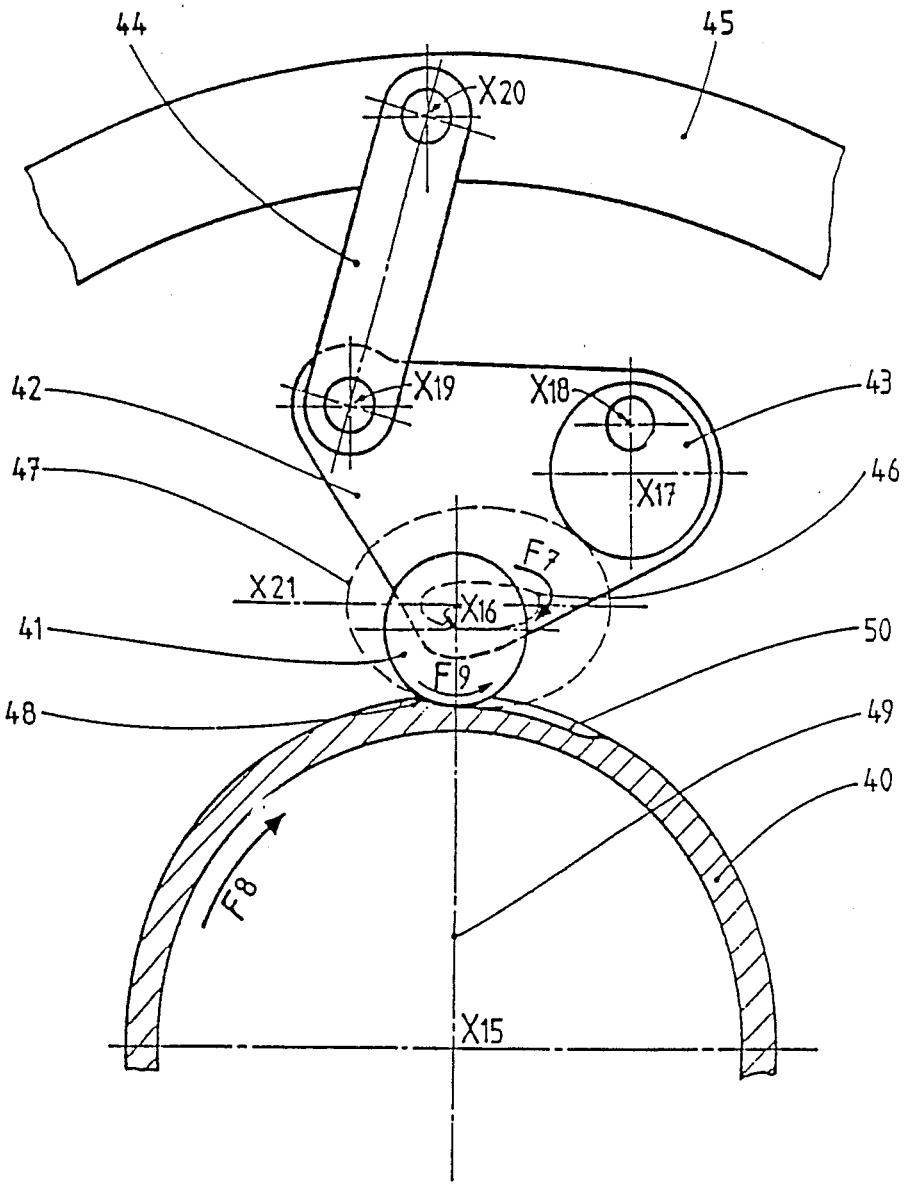
FIG. 7 is a view of an embodiment of the device according to the invention in which the knurling tool axis follows a path along a non-circular determined closed curve.

FIG. 7 describes a particular embodiment of the device according to the invention.

A wall of revolution 40 is shown in section and has an axis $X_{15}$ perpendicular to the plane of the sheet. A knurling tool 41 is mounted freely rotatably on an axis $X_{16}$ integral with a moveable rigid knurling tool holder 42. This knurling tool holder is mounted freely rotatably on a crank pin 43 of which the axis $X_{17}$ rotates about the axis $X_{18}$ which rotates in a clockwise direction via a driving means (not shown). A connecting rod 44 which is articulated at $X_{19}$ on the knurling tool holder and at $X_{20}$ on a holding ring 45 contributes to the guidance of the knurling tool holder 42. The axes $X_{16}$, $X_{17}$, $X_{18}$, $X_{19}$ and $X_{20}$ are parallel. Consequently, when the axis $X_{17}$ of the crank pin is driven round the axis $X_{18}$ in a clockwise direction by the driving means, the knurling tool axis $X_{16}$ cyclically follows the predetermined closed curve 46 in the direction of the arrow F7. The enveloping curve 47 of the path of the shaping edge of the knurling tool has a region of intersection 48 with the wall 40. The determined closed curve 46 has a greater diagonal axis $X_{21}$ which is also the large diagonal of the enveloping curve 47. The straight line 49 issuing from the axis $X_{16}$ and passing through the centre of the region of intersection 48 intersects $X_{21}$ substantially at right angles. Such an arrangement allows a small angle of incidence to be obtained by the shaping edge of the knurling tool when it engages in the region of intersection during each cycle. It is also possible to bring the enveloping curve 47 of the wall of revolution 40 closer or further away by rotating the ring 45 about its axis in a suitable direction and thus to adjust the depth of penetration of the edge of the knurling tool or again to perform cone tracking. It is thus possible to produce a helical thread 50 of constant depth on a conical wall. It can be seen that the knurling tool axis $X_{16}$ covers the determined closed curve 46 in a clockwise direction (direction of arrow F7). This direction is the same as the direction of rotation of the wall 40 indicated by the arrow F8. The knurling tool rolls in the direction of the arrow F9. The plane of the enveloping curve 47 may be turned about an axis such as the straight line 49 by means which are not shown so as to orientate it in parallel with a tangent to a helical thread passing through the region of intersection 48.

Figures 8, 9:
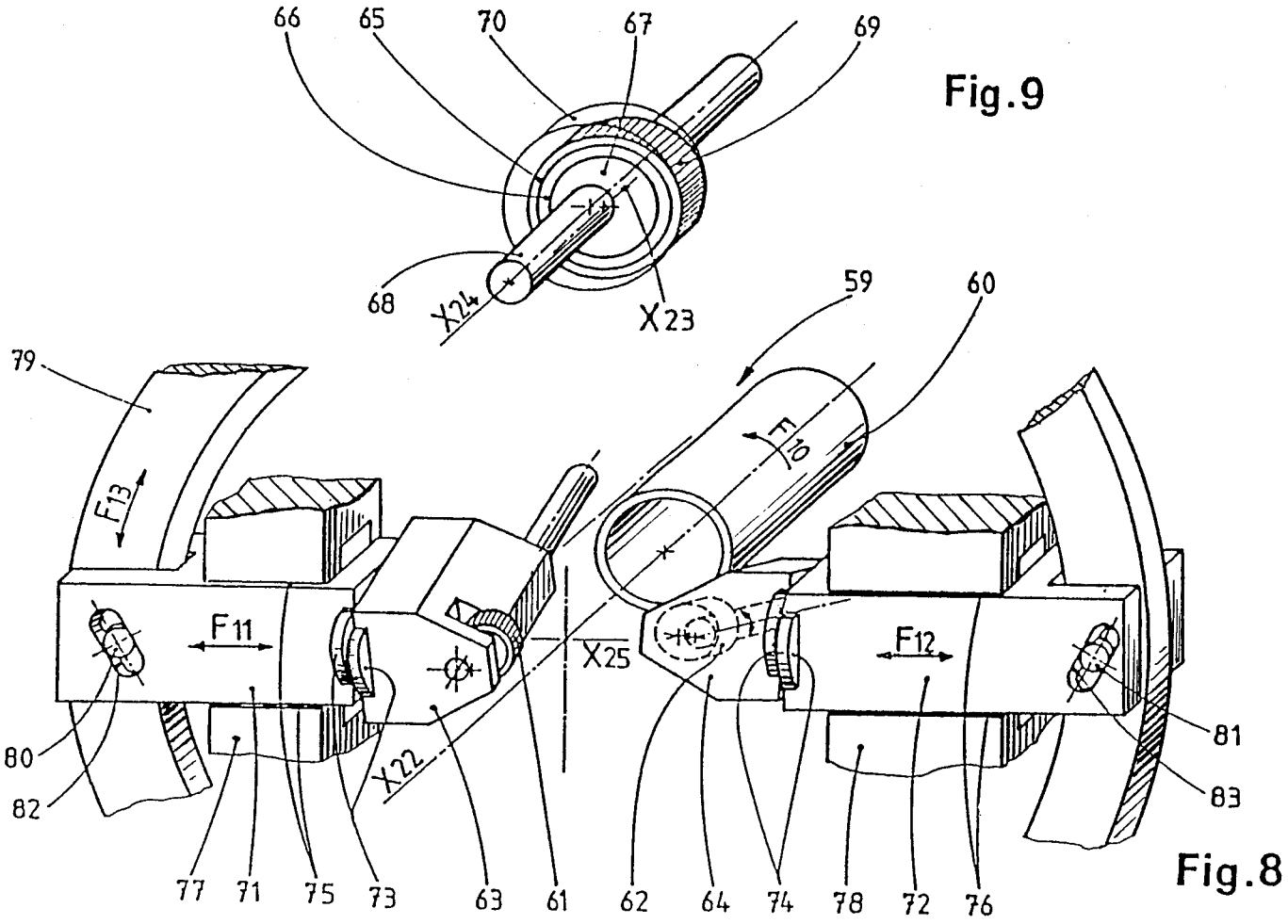
FIG. 8 is a view of a further embodiment of the device according to the invention comprising orientatable knurling tool holders.
FIG. 9 is a detail of a knurling tool from FIG. 8.

FIG. 8 as well as the detailed FIG. 9 show in part a perspective view of a further embodiment of the device according to the invention. In the device shown here, four knurling tools which are each mounted on a knurling tool holder and are distributed at 90° C. from one another about the axis [$X_{22}$] of a hollow body 59 on whose wall of revolution 60 a helical thread is to be produced are used. A driving means turns this wall 60 about its axis $X_{22}$ in the direction of arrow F10. To simplify FIG. 8, only two knurling tools 61 and 62 which are each mounted on a knurling tool holder suport 63, 64 and are distributed at 180° about the axis $X_{22}$ have been shown.

FIG. 9 shows clearly that the knurling tool 65 is an annular part mounted freely rotatably via a ball race 66 on a part 67 comprising a cylindrical bearing of axis $X_{23}$ which constitutes the axis of the knurling tool. A means for setting into rotation (not shown) causes rotation of a shaft 68 of axis $X_{24}$ which drives round it the axis $X_{23}$ which is parallel to it so that the point of intersection between this axis $X_{23}$ and a perpendicular plane cyclically describes a path along a determined closed curve. The part 67 is therefore the rigid and moveable knurling tool holder on which the knurling tool 65 is mounted. In the case shown in FIG. 9, this determined closed curve is a circumference of which the radius is equal to the distance between the axes $X_{23}$ and $X_{24}$. During its cyclic path, the shaping edge 69 of the knurling tool 65 describes an enveloping curve 70.

As shown in FIG. 8, each of the supports of the knurling tool holder 63, 64 can turn about an axis $X_{25}$ perpendicular to the axis $X_{22}$ which traverses the regions of intersection between the enveloping curves of the paths of the shaping edges of the knurling tools 61, 62 and the wall of revolution 60. For this purpose, each knurling tool holder support is mounted rotatably about this axis $X_{25}$ on the carriage 71, 72 bearing it. Some verniers 73, 74 enable the inclination of the support 63, 64 and therefore of the corresponding knurling tool holder to be adjusted so that the enveloping curve of the path of the shaping edge of the knurling tool is parallel to the tangent to the helical thread to be produced in the region of intersection. Each of the carriages 71, 72 is able to slide radially in one direction or the other along the arrows F11, F12 relative to the axis $X_{22}$ in slideways such as 75, 76 made in some stationary supporting members 77, 78.

The radial movement of all the carriages is controlled by means of a collar 79 which can be rotated in one direction or the other along the arrow F13 about its axis which is substantially combined with the axis $X_{22}$. The collar 79 bears rollers 80, 81 engaging in inclined notches 82, 83 formed at the ends of the carriages 71, 72. It is thus possible, owing to a suitable control means, simultaneously to move the knurling tool supports in a radial manner. This allows, in particular, cone tracking. As in the examples already mentioned, some helical threads are produced by moving the hollow body 59 in a relative translation manner along its axis $X_{22}$ with respect to the knurling tools. If a helical thread is produced on a conical wall, the translation movement of the hollow body 59 is synchronised along the axis $X_{22}$ by known means with the simultaneous radial movement of the knurling tool holders by the action of the collar 79.

As already mentioned, the depth of a groove may be equalised, in particular if it is a helical thread, by causing a smoothing roller of which the axis is kept at a substantially constant distance from the wall of revolution to roll at constant pressure. In the embodiment of the device according to the invention, the cyclic driving device of the knurling tool holder on one of the knurling tool supports may be replaced, in particular, by a device in which the knurling tool axis is fixed relative to the knurling tool holder support. Three shaping knurling tools with cyclic action can thus be arranged in the direction of advance of the helical thread so as progressively to form the thread to the desired depth. The fourth knurling tool holder support will be equipped with a smoothing roller whose axis distance with the wall of revolution will be adjusted to a fixed value such that the knurling tool rolls continuously in the bottom of the thread already formed while equalising its walls. The profile of this smoothing roller will correspond to the definitive profile to be imparted to the helical thread. In order further to improve the profile of the thread, six knurling tool supports may be distributed round the axis of the wall of revolution instead of four, and two of these supports can be equipped with smoothing rollers having fixed axes, which roll continuously on the bottom of the thread while equalising the profile.

As a numerical example, a device corresponding to the one shown in FIGS. 8 and 9 will be used for the production of a helical thread on the external wall of a steel tube having an external diameter of $3\frac{1}{2}$ inches and a wall thickness of 6 mm. This tube will be rotated about its axis at a speed of 9 rpm and the tube will translated along its axis in a relative manner with respect to the knurling tools at a speed of 38.1 mm/min. The four knurling tool holders, arranged at 90° from one another are each equipped with a 61 mm diameter knurling tool provided with a single shaping edge. Three of these knurling tools are mounted freely rotatably in the manner shown in FIG. 9, that is to say their axis moves cyclically in parallel with itself while following a circumference situated in a plane perpendicular to it under the influence of a driving means (not shown). The radius of the circumference is 0.4 mm and the number of cycles is from 2,000 to 3,000 per minute, depending on the material to be shaped. The fourth knurling tool is a smoothing roller which is mounted freely rotatably on a fixed axis. The knurling tool supports are adjusted in radial distance from the tube wall in such a way that the maximum depth of total penetration of each of the shaping edges of the knurling tools is:

First knurling tool: 0.4 mm
Second knurling tool: 0.8 mm
Third knurling tool: 1.2 mm
Fourth knurling tool: 1.2 mm It can be seen that the first three knurling tools progressively form the thread by each making their own penetration of 0.4 mm. The fourth knurling tool operates at the depth attained by the third one, but at a constant depth, thus equalising the thread.

The knurling tool holder supports are inclined in the manner just described so that the enveloping curve of the path of the shaping edge of each of the first three knurling tools is parallel to the tangent to the helical thread to be produced. The same inclination is given to the knurling tool holder support on which the fourth knurling tool of fixed axis is mounted. It is found that the helical thread thus produced has excellent precision and an excellent surface state and that the internal sides of the tube have not been substantially modified in the region in which external screw cutting is effected.

Numerous modifications may be made to the process and to the device just described for using them without departing from the scope of the invention. In particular, the knurling tools can be adapted to the production of any groove profile to be produced. If the proposed groove is a helical thread, its profile can be given the optimum shape for obtaining the qualities of suitability for gripping and tightness expected of a screwed joint.

The process and the devices according to the invention can allow numerous applications which will also form part of the invention.

We claim:

1. The process of forming helical grooves in the wall of revolution of a tubular body (2) without removal of the material from which said body is made, these helical grooves forming threads for screw threaded assemblies, comprising the steps of:

(1) supporting said tubular body (2) for rotation around its own axis (X1);

(2) mounting at least one profiling tool of revolution, freely rotatable, around an axis perpendicular to a radius of said tube;

(3) moving said tool axis in parallel with itself along a determined closed curve (12, 22), the enveloping curve (14, 23) of the path of the edge of the profiling tool including a portion effecting cyclical engagement of said tool and said wall and wherein the diameter of said tool is greater than the length of a diagonal (DE) of the determined closed curve (22) of which the extension cuts the region of engagement (25) as well as the axis (X5) of the tubular body, the length of that diagonal (DE) being at least equal to the deepness of penetration (e1) of the edge of the profiling tool within the wall (20);

(4) applying sufficient pressure to said profiling tool against said tubular body to form a continuous complementary profile on the wall of said tubular body, the displacement without removal of said body material in at least one profiling step; and (5) rotating said tubular body and moving cyclically the axis of the profiling tool along the determined closed curve while longitudinally displacing said tube and said tool relative to each other to form a helical groove over a predetermined area of said tubular body.

2. The process of forming helical grooves in the wall of revolution of a tubular body without removal of the material from which said body is made, these helical grooves forming threads for screw-threaded assemblies, comprising the steps of:

(1) supporting said tubular body for rotation around an axis;

(2) mounting at least one profiling tool of revolution freely rotatable around an axis;

(3) moving said tool axis in parallel with itself so that its point of intersection with a perpendicular plane follows in cyclic manner a determined closed curve, the enveloping curve of the path of the edge of the profiling tool including a portion effecting cyclical engagement of said tool and said wall, the axis of said tool being in a plane substantially parallel to the plane tangential to the generating line of the wall of the tubular body passing through the region of engagement and wherein the diameter of said tool is greater than the length of a diagonal of the determined closed curve of which the extension cuts the region of engagement as well as the axis of the tubular body, the length of that diagonal being at least equal to the deepness of penetration of the edge of the profiling tool within the wall;

(4) applying sufficient pressure to said profiling tool against said tubular body to form a continuous complementary profile on the wall of said tubular body, by displacement without removal of said body material in at least one profiling step; and (5) rotating said tubular body and moving cyclically the axis of the profiling tool along the determined closed curve while longitudinally displacing said tube and said tool relative to each other to form a helical groove over a predetermined area of said tubular body.

3. A process according to claim 1 or 2 wherein the plane of the enveloping curve is preferably orientated such that it is parallel to a tangent to the helical groove in the region of engagement.

4. A process according to claim 1 or 2 wherein the determined closed curve (12) is circular.

5. A process according to claim 1 or 2 wherein the determined closed curve (22) has an elongate shape and is orientated in such a way that a diagonal of this curve (E-D) of which the extension cuts the region of engagement (25) and also cuts the axis ($X_5$) of the wall of the tubular body and is substantially perpendicular to the longest diagonal (BC) of this determined closed curve.

6. A process according to claim 1 or 2 wherein the plane of the enveloping curve of the path of the profiling tool (61, 62) is adjustable about an axis ($X_{25}$) contained in this plane which intersects both the region of engagement and the axis $X_{22}$ of the wall of revolution of the hollow body.

7. A process according to claim 1 or 2 wherein the plane of the enveloping curve is positioned parallel to a tangent to the helical groove (31) being produced in the region of engagement.

8. A process according to claim 1 and 2, wherein a plurality of profiling tools are employed, the enveloping curves of the path of the edge of each profiling tool being positioned around the wall of the tubular body in such a way that each of them has a different region of engagement with this wall.

9. A process according to claim 1 or 2, wherein a helical groove is produced on a non-cylindrical wall (34) of revolution of a hollow tubular body, and wherein the distance between the axis of said wall and at least one enveloping curve corresponding to the path of the edge of a profiling tool (36) is varied to control the depth of the region of engagement between said tool and said tubular body.

10. A process according to claim 1 or 2, wherein, for an observer placed in the extension of the axis of the wall of the tubular body, the direction of rotation (F1, F6) of said wall (10, 20) and the direction of travel (F2, F4) of a determined closed curve (12, 22) through the point of intersection of the axis of the corresponding tool are the same.

11. A process according to claim 1 or 2 wherein a smoothing tool includes an axis maintained at a substantially constant distance from the wall of said tubular body and in a groove previously formed upstream of this smoothing tool.

12. A device for forming grooves on the wall of revolution of a tubular body, composed of a ductile or plastic material without removal of matter, comprising a first driving support means including gripping means for said tubular body grasping said body in such a way that the axis of the body coincides with the axis of rotation of the support, and wherein at least one rigid profiling tool holder (42, 67) mounts a single profiling tool (41, 65), of revolution, freely rotatable on an axis ($X_{16}$, $X_{23}$) integral with said tool holder, and a second driving means (43, $X_{24}$) moves said tool holder cyclically to move said tool axis in parallel with itself, wherein its point of intersection with a perpendicular plane defines, in cyclic manner, a determined closed curve (46), adjustment means (44, 71) permitting the adjustment of the distance between the tool holder and the wall of said tubular body to be varied wherein the enveloping curve of the cyclic path of at least one edge of a profiling tool defines a region of engagement with the wall of said tubular body.

13. A device according to claim 12 wherein the tool (41) includes at least one edge having a diameter greater than the length of a diagonal of the determined closed curve (46) of which the extension cuts the region of engagement (48) as well as the axis ($X_{15}$) of the wall of the tubular body.

14. A device according to claim 12, wherein the determined closed curve followed cyclically by the axis ($X_{23}$) of a profiling tool (65) is a circumference.

15. A device according to claim 12 wherein translation means moves the hollow body (59) along its axis ($X_{22}$) in a relative manner with respect to said tool and in synchronization with its movement about the same axis ($X_{22}$) to form a helical groove in said tubular body.

16. A device according to claim 12 wherein the determined closed curve (46) is non-circular and is orientated relative to the wall of said tubular body so that its greatest diagonal is substantially perpendicular to a diagonal of which the extension cuts the region of engagement as well as the axis of the wall of said tubular body.

17. A device according to claim 12 wherein at least one tool holder (67) is adjustable about an axis ($X_{25}$) located in the plane of the enveloping curve of the path of at least one tool which corresponds to said tool holder, said axis cutting both the region of intersection and the axis $X_{22}$ of the wall of said tubular body.

18. A device according to claim 17 wherein a plurality of profiling tools (26, 27, 28, 29) engage a common groove each to a different depth.

19. A device according to claim 12 wherein a driving means (79) drives at least one tool holder in the direction of the axis ($X_{25}$) of the wall of said tubular body (60) as a function of the relative translation of said wall along said axis relative to said tool holder.

20. A device according to claim 12 wherein a plurality of tool holders each equipped with a single tool (61, 62) are distributed around the axis of said tubular body.

21. A device according to claim 34 wherein at least one profiling tool (26, 27, 28, 29) includes a plurality of shaping edges (A1-B1), A2-B2, A3-B3, A4-B4).

22. A device according to claim 12 wherein at least one tool holder is equipped with a smoothing roller, the axis of which does not perform cyclic movement, the device further comprising at least one tool holder equipped with a profiling tool configured to form a groove within which said smoothing roller rolls continuously.

* * * * *